US007408102B2

(12) United States Patent
Kugimoto

(10) Patent No.: US 7,408,102 B2
(45) Date of Patent: Aug. 5, 2008

(54) JACK MOTION-RESTRICTING DEVICE FOR UPRIGHT PIANO

(75) Inventor: Hidenori Kugimoto, Shizuoka-ken (JP)

(73) Assignee: Kabushiki Kaisha Kawai Gakki Seisakusho, Hamamatsu-shi (JP)

( * ) Notice: Subject to any disclaimer, the term of this patent is extended or adjusted under 35 U.S.C. 154(b) by 3 days.

(21) Appl. No.: 11/702,354

(22) Filed: Feb. 5, 2007

(65) Prior Publication Data

US 2007/0180974 A1 Aug. 9, 2007

(30) Foreign Application Priority Data

Feb. 9, 2006 (JP) ..... 2006-032901

(51) Int. Cl.
*G10C 3/18* (2006.01)

(52) U.S. Cl. ..... 84/402; 84/240; 84/241; 84/242; 84/243

(58) Field of Classification Search ..... 84/240–243
See application file for complete search history.

(56) References Cited

U.S. PATENT DOCUMENTS

| | | | | | |
|---|---|---|---|---|---|
| 3,012,459 | A | * | 12/1961 | Wood et al. | 84/240 |
| 3,139,781 | A | * | 7/1964 | Andersen et al. | 84/240 |
| 3,147,659 | A | * | 9/1964 | Andersen et al. | 84/240 |
| 3,171,320 | A | * | 3/1965 | Underwood, Jr. | 84/240 |
| 3,228,277 | A | * | 1/1966 | Roehrig | 84/240 |
| 3,280,686 | A | * | 10/1966 | Andersen et al. | 84/240 |
| 3,435,720 | A | * | 4/1969 | Eaton | 84/240 |
| 4,119,008 | A | * | 10/1978 | Kimble | 84/242 |
| 4,879,939 | A | * | 11/1989 | Wall | 84/240 |
| 4,896,577 | A | * | 1/1990 | Trivelas et al. | 84/240 |
| 5,042,354 | A | * | 8/1991 | Trivelas et al. | 84/240 |
| 5,123,321 | A | * | 6/1992 | Caught | 84/242 |
| 5,196,638 | A | * | 3/1993 | Hayashida et al. | 84/240 |
| 5,353,671 | A | * | 10/1994 | Inoue et al. | 84/236 |
| 5,509,340 | A | * | 4/1996 | Kawamura | 84/236 |
| 5,511,454 | A | * | 4/1996 | Jones et al. | 84/236 |
| 5,679,914 | A | * | 10/1997 | Niitsuma | 84/687 |
| 5,949,013 | A | * | 9/1999 | Satoshi | 84/719 |
| 2007/0180974 | A1 | * | 8/2007 | Kugimoto | 84/240 |

FOREIGN PATENT DOCUMENTS

| | | | |
|---|---|---|---|
| EP | 1818908 | A2 * | 8/2007 |
| JP | 5-323953 | | 12/1993 |
| JP | 2007212785 | A * | 8/2007 |

* cited by examiner

*Primary Examiner*—Lincoln Donovan
*Assistant Examiner*—Robert W Horn
(74) *Attorney, Agent, or Firm*—Crowell & Moring LLP

(57) ABSTRACT

A jack motion-restricting device for an upright piano, which is capable of maintaining constant a jack motion-restricting position by a simple construction to thereby obtain an intended operation of the jack. The jack motion-restricting device restricts the motion of the jack operating in accordance with key depression by having the jack abut thereagainst. A base part of the device is provided at a location close to the jack. A base layer of the same is formed of a material having dimensional stability, and is affixed to the base part. A surface layer of the same is formed of a material having abrasion resistance and flexibility, and is affixed to the base layer, for having the jack abut thereagainst.

5 Claims, 2 Drawing Sheets

JACK MOTION-RESTRICTING DEVICE FOR UPRIGHT PIANO

BACKGROUND OF THE INVENTION

1. Field of the Invention

The present invention relates to a jack motion-restricting device for an upright piano, such as a butt and a regulating button, which restricts the motion of a jack by having the jack abut thereagainst.

2. Description of the Related Art

Conventionally, there have been proposed a butt and a regulating button for an upright piano e.g. in Japanese Laid-Open Patent Publication (Kokai) No. H05-323953. The butt is integrally formed with a hammer, as a part of a hammer assembly, and is formed by a synthetic resin molded article. The butt has a butt felt provided on a lower end of the front surface thereof. In general, the butt felt is formed of woolen felt, and has a block shape. The regulating button is fixedly disposed on the lower surface of a regulating rail. The regulating button is formed by a cylindrical synthetic resin molded article, and has leather affixed to the lower surface thereof.

In the key-released state, a jack is held in oblique contact with the front surface of the butt felt while supporting the hammer assembly including the butt by a hammer thrust-up part, whereby the stationary position of the jack in the key-released state is defined. The regulating button in the key-released state is positioned above a base part of the jack with a predetermined space from the base part.

When a key is depressed, the associated whippen is thrust up by the key, and the associated jack is moved upward together with the whippen to thrust up the associated hammer assembly. During this process, the base part of the jack comes into abutment with the leather of the associated regulating button, whereby the motion of the jack is restricted. As a consequence, the jack is pivotally moved about the whippen, with its base part sliding on the surface of the leather, and the hammer thrust-up part is disengaged forward from the associated butt (i.e. let off). Immediately after the let-off, the hammer of the hammer assembly strikes the associated string to generate a piano tone.

Then, when the key is released, the jack moves downward together with the whippen while being pivotally moved by the associated jack spring in a direction reverse to the direction in which the jack was moved by key depression. Then, the hammer thrust-up part comes into abutment with the butt felt of the butt having performed a return pivotal motion, whereby the pivotal motion of the jack is stopped. A shock caused by abutment of the jack against the butt felt is absorbed by the butt felt, whereby generation of noise is prevented.

However, in the above-described upright piano, the butt felt is liable to expand or shrink according to changes in humidity because it is formed of wool which is a natural fiber. The stationary position of the jack in the key-released state is defined by the butt felt as described above, and hence a change in the thickness of the butt felt causes a displacement of the stationary position of the jack from a predetermined proper position. This results in changes in key touch feeling and timing for let-off or the like, which can cause a problem in touch control.

Further, since the jack strongly abuts against the butt felt whenever the key is depressed, the butt felt progressively loses its resilience due to the repeated abutment of the jack thereagainst, and finally becomes incapable of restoring from the compressed and deformed state. In such a case, the stationary position of the jack shifts in the direction of depth of the butt, which also causes changes in key touch feeling and the like. Furthermore, after coming into abutment with the butt felt, the jack, which basically performs a pivotal motion, slides on the butt felt, and hence abrasion of the butt felt occurs. Due to this abrasion, the thickness of the butt felt changes, which can cause the same inconveniences as mentioned above.

To eliminate the inconveniences, it can be envisaged that the butt felt is formed of a harder material, such as the leather used for the regulating button. In this case, however, noise is liable to occur due to abutment of the jack against the butt felt, which can cause a problem in musical performance.

As to the regulating button, since the leather is affixed to the lower surface thereof, there is also a fear that noise may be generated when the key is depressed, particularly when the key is strongly hit, thereby causing the jack to strongly abut against the regulating button. To eliminate this inconvenience, it can be envisaged that the same kind of felt as used for the butt felt is used for the regulating button in place of the leather. However, in this case, as described above, the felt expands or shrinks according to changes in humidity, and abrasion of the regulating button occurs when the jack slides on the surface of the regulating button, whereby the thickness of the regulating button is changed. This causes a displacement of the jack abutment position on the regulating button from a predetermined proper position. As a result, let-off timing changes, which can cause a problem in touch control.

SUMMARY OF THE INVENTION

It is an object of the invention to provide a jack motion-restricting device for an upright piano, which is capable of maintaining constant a jack motion-restricting position by a simple construction to thereby ensure a required stable operation of the jack.

To attain the above object, the present invention provides a jack motion-restricting device for an upright piano, which restricts motion of a jack operating in accordance with key depression, by having the jack abut thereagainst, comprising a base part that is provided at a location close to the jack, a base layer that is formed of a material having dimensional stability, and is affixed to the base part, and a surface layer that is formed of a material having abrasion resistance and flexibility, and is affixed to the base layer, for having the jack abut thereagainst.

This jack motion-restricting device for an upright piano has the base part, and the base layer and the surface layer sequentially affixed to the base part in the mentioned order. The base layer has dimensional stability, and the surface layer has abrasion resistance and flexibility. The jack is brought into abutment with the surface layer as the key is depressed, whereby the motion of the jack is restricted.

With this arrangement of the jack motion-restricting device, the base layer has dimensional stability, and hence even when load is repeatedly applied to the base layer via the surface layer due to repeated abutment of the jack against the surface layer or when ambient environment conditions including humidity change, the thickness of the base layer hardly changes. Further, since the surface layer has abrasion resistance, abrasion of the surface layer caused by sliding of the jack thereon can be suppressed. From the above, it is possible to maintain substantially constant the total thickness of the base layer and the surface layer, and hence also maintain substantially constant the jack motion-restricting position which is determined by the thickness of the base layer and that of the surface layer. This makes it possible to stably obtain the intended operation of the jack.

Further, since the surface layer has flexibility, it is possible to reduce a shock caused by abutment of the jack against the surface layer and prevent generation of noise. As described above, the simple construction realized simply by affixing the surface layer to the base layer enables the jack motion-restricting device to perform various functions required thereof, differently from the conventional case in which the single material is used.

Preferably, the base part is formed of a chemical fiber.

With the arrangement of this preferred embodiment, the base part is formed of a chemical fiber, and hence it is possible to considerably reduce the amount of change in the thickness of the base layer due to a change in humidity, to thereby reliably obtain the advantageous effects described above.

Preferably, the surface layer is formed of a fluoropolymer fiber.

With the arrangement of this preferred embodiment, the surface layer is formed of a fluoropolymer fiber, and hence has flexibility and abrasion resistance. Therefore, it is possible to excellently obtain the above-described advantageous effects. Further, since the fluoropolymer fiber has a high lubricity, the jack having abutted on the surface layer can smoothly slide thereon, which makes it possible to further suppress abrasion of the surface layer due to sliding on the jack. Furthermore, although fluoropolymers are relatively expensive, since the fluoropolymer fiber is used only for the surface layer, it is possible to suppress increase in manufacturing costs.

Preferably, the jack motion-restricting device is a butt against which the jack performing a return pivotal motion in accordance with key release abuts to thereby define a stationary position of the jack in a key-released state.

With the arrangement of this preferred embodiment, the jack motion-restricting device is a butt, and hence a portion of the butt corresponding to the conventional butt felt is formed by the base layer and the surface layer, whereby the stationary position of the jack in the key-released state can be maintained substantially constant, which makes it possible to obtain stable key touch feeling and let-off timing.

Preferably, the jack motion-restricting device is a regulating button against which the jack moving upward in accordance with key depression abuts to thereby cause the jack to perform a pivotal motion to cause let-off to occur.

With the arrangement of this preferred embodiment, the jack motion-restricting device is a regulating button. This enables the position of abutment of the jack during key depression to be maintained substantially constant, which makes it possible to obtain stable let-off timing.

The above and other objects, features, and advantages of the invention will become more apparent from the following detailed description taken in conjunction with the accompanying drawings.

DETAILED DESCRIPTION OF THE PREFERRED EMBODIMENTS

Figure 1:
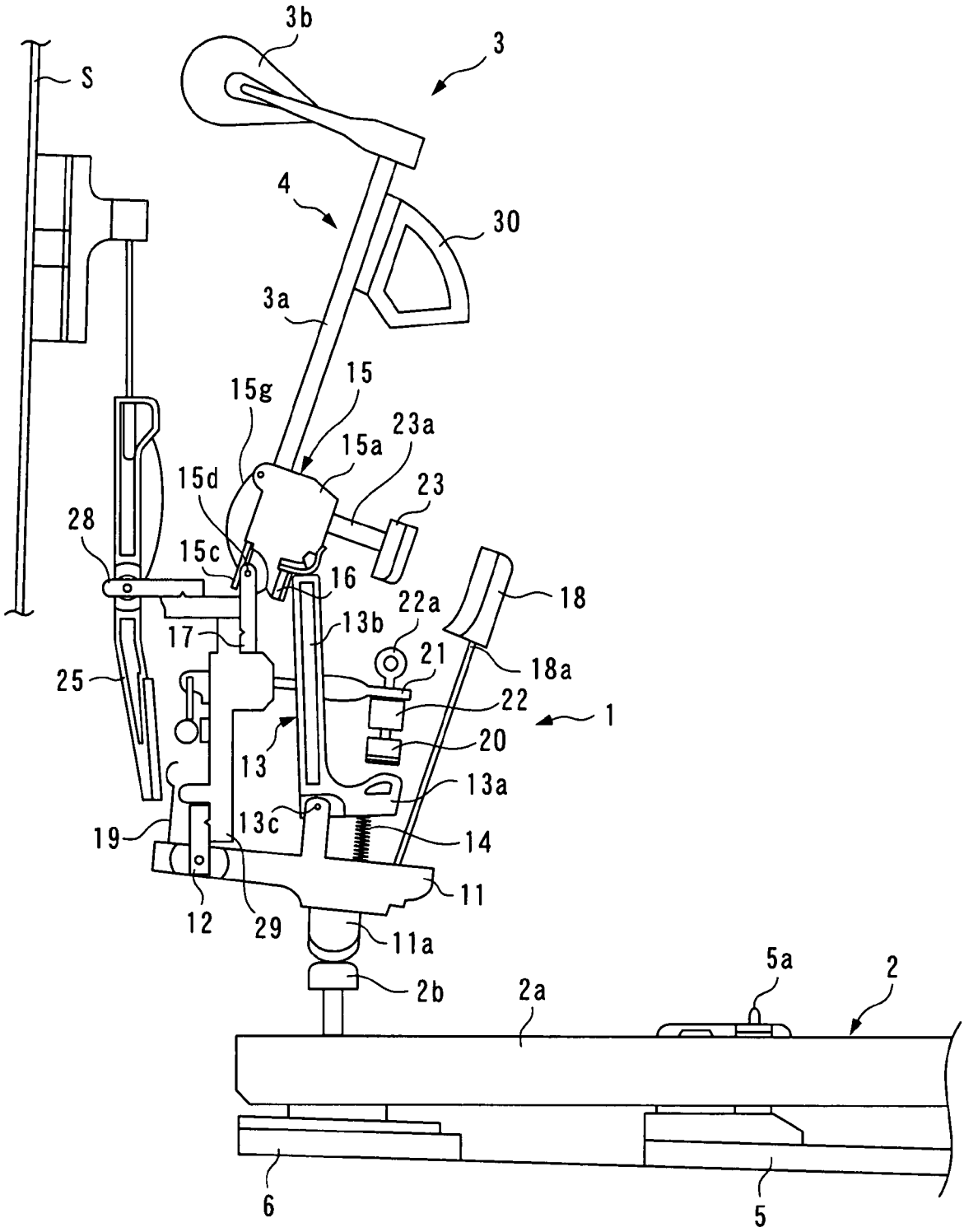
FIG. 1 is a side view of a keyboard, an action, a hammer, and component parts associated with these, of an upright piano to which is applied a jack motion-restricting device according to the present invention, in the key-released state.

The invention will now be described in detail with reference to the drawings showing a preferred embodiment thereof. FIG. 1 shows an action 1, a keyboard 2, and a hammer 3 of an upright piano to which is applied a jack motion-restricting device according to the present invention, in the key-released state. In the following description, a player's side of the upright piano will be referred to as "front", and the opposite side remote from the player as "rear".

The keyboard 2 is comprised of numerous keys 2*a* (only one of which is shown) arranged in the transverse direction of the upright piano. Each of the keys 2*a* extends in the front-rear direction (left-right direction, as viewed in FIG. 1), and has a central portion thereof pivotally supported by a balance pin 5*a* erected from a keyframe 5 on a keybed (not shown). At a location rearward of the keyframe 5, there is disposed a back rail 6 on which is rested the rear end of each key 2*a*.

On each of the left and right ends of the keybed, there is mounted an action bracket (not shown). The actions 1 (only one of which is shown) are arranged above the rear end of the keyboard 2 at a location between the two action brackets. Each action 1 includes a whippen 11, a jack 13, and a butt 15 (jack motion-restricting device). The whippens 11, the jacks 13, and the butts 15 are provided on a key-by-key basis (only one is shown for each of them).

A center rail 29 and a hammer rail 30 extend between the left and right action brackets. A whippen flange 11 and a butt flange 17 are screwed to the center rail 29 in association with each key 2*a* (only one is shown for each of them). The whippen 11 has a rear end thereof pivotally supported by the whippen flange 12. The butt 15 is integrated with other component parts including the hammer 3 to form a hammer assembly 4. The butt 15 has a lower end part thereof pivotally supported by the butt flange 17 via a center pin 15*d*.

The whippen 11 is made by forming e.g. a synthetic resin into a predetermined shape. The whippen 11 has a heel part 11*a* projecting downward from a front part thereof, and rests on a capstan button 2*b* provided on a rear end of the associated key 2*a* via the heel part 11*a*. A back check wire 18*a* is erected on a front end of the upper surface of the whippen 11, and a back check 18 is mounted on an end of the back check wire 18*a*. A spoon 19 for driving a damper 25, described hereinafter, is erected on a rear end of the upper surface of the whippen 11. The aforementioned whippen flange 12 is located immediately forward of the spoon 19, and has an upper part thereof fixed to the center rail 29.

The jack 13 is formed e.g. of an ABS resin and is comprised of a base part 13*a* extending in the front-rear direction and a hammer thrust-up part 13*b* extending upward from the base part 13*a*. The jack 13 has a corner part formed by the base part 13*a* and the hammer thrust-up part 13*b*, and is pivotally supported by the whippen 11 at a location rearward of the back check wire 18*a* via a pin-like pivot 13*c* inserted through the corner part. A jack spring 14 formed by a coil spring is provided between the base part 13*a* and the whippen 11.

The center rail 29 is formed with a plurality of regulating brackets 21 (only one of which is shown) each extending forward, and a regulating rail 22 extending in the left-right direction is mounted on the front ends of the respective regulating brackets 21. Regulating screws 22*a* (only one of which is shown) are screwed into the regulating rail 22 from above on a key-by-key basis. Each of the regulating screws 22*a* projects downward from the regulating rail 22, and a regulating button 20 (jack motion-restricting device) is fixed to the lower end of the associated regulating screw 22*a*.

Figure 2:
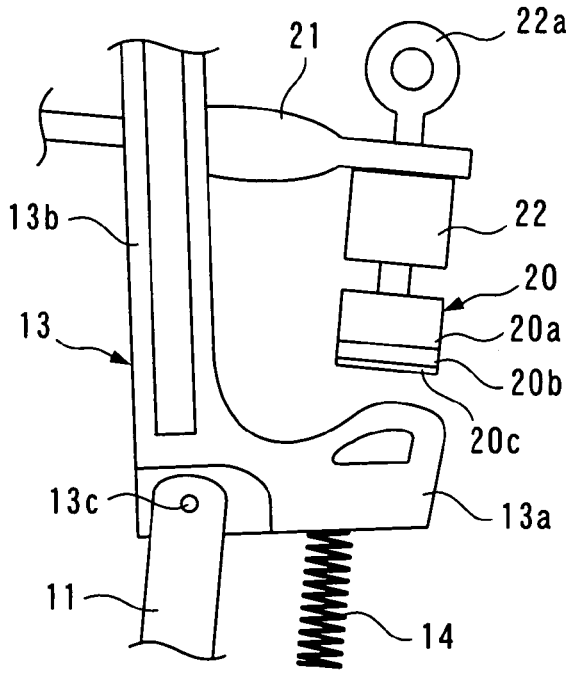
FIG. 2 is an enlarged partial side view of a jack and a regulating button of the action, appearing in FIG. 1.

As shown in FIG. 2, the regulating button 20 is comprised of a base part 20*a*, a base layer 20*b*, and a surface layer 20*c* formed from top to bottom in the mentioned order. The base part 20*a* is formed by a molded article of a synthetic resin, such as an ABS resin. The base part 20*a* has a cylindrical shape and is fixed to the regulating screw 22*a*. The base layer 20*b* is formed of a material having dimensional stability, e.g. a high-density chemical fiber, such as rayon, and is affixed to the lower surface of the base part 20*a* e.g. by a double-faced tape. The surface layer 20*c* is formed of a material having flexibility, abrasion resistance, and lubricity, e.g. a fluoropolymer fiber, and has a smaller thickness than the base layer 20*b*. The fibers of the two layers 20*b* and 20*c* are entangled with each other by needle punching, whereby the surface layer 20*c* is joined to the base layer 20*b*.

The butt 15 includes a butt body 15*a* (base part), and a butt skin 15*b* and a butt felt 16 which are affixed to the butt body 15*a*. The butt body 15*a* is made by forming e.g. an ABS resin into a predetermined shape. A metal plate 15*c* is screwed and fixed to a lower part of the rear surface of the butt body 15*a*, and a center pin 15*d* inserted through an upper part of the butt flange 17 is sandwiched between the butt body 15*a* and the metal plate 15*c*. This enables the hammer assembly 4 to perform a pivotal motion about the center pin 15*d*. Further, between the butt body 15*a* and the butt flange 17, there is provided a butt spring 15*g* which urges the hammer assembly 4 in the clockwise direction as viewed in FIG. 1.

Figure 3:
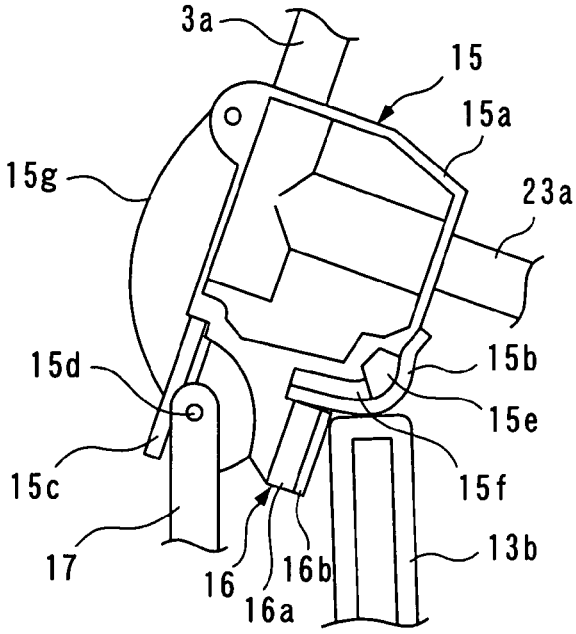
FIG. 3 is an enlarged partial side view of a butt and adjacent parts of a hammer assembly appearing in FIG. 1.

As shown in FIG. 3, the butt felt 16 is affixed to a lower part of the front surface of the butt body 15*a*. The butt felt 16 generally has a block shape, and is comprised of a base layer 16*a* and a surface layer 16*b*. Similarly to the base layer 20*b* of the regulating button 20, the base layer 16*a* is formed of a chemical fiber having dimensional stability, e.g. a high-density fiber, such as rayon. The base layer 16*a* has a predetermined thickness, and is affixed to the butt body 15*a* e.g. by a double-faced tape. The surface layer 16*b* is formed of a material having flexibility, abrasion resistance, and lubricity, e.g. a fluoropolymer fiber, similarly to the surface layer 20*c* of the regulating button 20, and has a smaller thickness than the base layer 16*a*. The fibers of the two layers 16*a* and 16*b* are entangled with each other by needle punching, whereby the surface layer 16*b* is joined to the base layer 16*a*.

Further, an under felt 15*e* and an under cloth 15*f* are affixed to the butt body 15*a* side by side in the front-rear direction at a location adjacent and above the butt felt 16. The butt skin 15*b* is affixed to the butt felt 16 in a manner covering the under felt 15*e* and the under cloth 15*f*.

Further, the butt 15 is provided with a catcher shank 23*a*. The catcher shank 23*a* extends forward from the butt body 15*a*, and a catcher 23 is mounted to the front end of the catcher shank 23*a* in facing relation to the back check 18 located forward of the catcher 23.

The hammers 3 (only one of which is shown) are also provided on a key-by-key basis. Each hammer 3 is erected on the upper surface of the associated butt 15, and is comprised of a hammer shank 3*a* extending upward and a hammer head 3*b* mounted on the upper end of the hammer shank 3*a*. The hammer head 3*b* is opposed to the associated string S which is stretched at a location rearward thereof. At a location rearward of the center rail 29, the dampers 25 are pivotally mounted on the respective associated damper flanges 28, on a key-by-key basis.

With this arrangement, as shown in FIG. 3, in the key-released state, the upper end of the hammer thrust-up part 13*b* of the jack 13 is held in engagement with the butt skin 15*b* of the butt 15, and at the same time is held in abutment with the front surface of the butt felt 16 in a state tilted with respect to the same. Thus, the jack 13 supports the hammer assembly 4 in a stationary position defined by the butt felt 16. Further, as shown in FIG. 2, the base part 13*a* of the jack 13 is positioned below the regulating button 20 with a predetermined space therebetween.

In the following, a description will be given of a sequence of operations of the above-described upright piano from the start of key depression to the end of the same. When the player depresses the key 2*a* in the key-released state shown in FIG. 1, the key 2*a* pivotally moves about the balance pin 5*a* in the clockwise direction as viewed in FIG. 1, whereby the whippen 11 placed on the rear end of the key 2*a* is thrust up by the key 2*a* to pivotally move upward (in the counterclockwise direction). With this pivotal motion of the whippen 11, the jack 13 and other associated component parts provided on the whippen 11 move upward, whereby the hammer assembly 4 is thrust up by the hammer thrust-up part 13*b* of the jack 13 to pivotally move counterclockwise toward the string S disposed rearward of the hammer assembly 4.

When the key 2*a* is further pivotally moved, the front end of the base part 13*a* of the jack 13 comes into abutment with the regulating button 20 from below. As a consequence, the upward movement of the jack 13 is stopped by the regulating button 20, whereby the base part 13*a* is pivotally moved about the whippen 11 in the clockwise direction while sliding on the surface layer 20*c*.

Then, when the key 2*a* is further pivotally moved, the hammer thrust-up part 13*b* is disengaged forward from the butt 15, whereby the jack 13 is let off the hammer assembly 4. At this time, the weight of the hammer assembly 4 is lost from the touch weight of the key 2*a*. This sharp reduction of the touch weight makes the player feel let-off feeling.

Even after the jack 13 is let off the hammer assembly 4, the hammer assembly 4 continues the pivotal motion by inertia, whereby the hammer 3 strikes the string S and vibrates the same to thereby generate a piano tone. Then, the hammer assembly 4 is caused to perform a clockwise return pivotal motion by the resilient force of the string S.

When the key 2*a* is released after completion of key depression, the key 2*a*, the action 1, and the other associated component parts are pivotally moved back in respective directions opposite to directions in which they are moved during key depression. Specifically, with the return pivotal motion of the whippen 11, the jack 13 moves downward together with the whippen 11. At this time, the jack 13 is caused to perform a counterclockwise return pivotal motion by the urging force of the jack spring 14, and with this return pivotal motion of the jack 13, the base part 13*a* slides on the surface layer 20*c* of the regulating button 20.

On the other hand, the hammer assembly 4 is caused to perform a clockwise return pivotal motion by the urging force of the butt spring 15*g*. During this return motion of the hammer assembly 4, the hammer thrust-up part 13*b* of the jack 13 is moved in under the butt 15 and comes into abutment with the surface layer 16*b* of the butt felt 16, whereby the return motion of the jack 13 is stopped. A shock caused by this abutment is absorbed by the surface layer 16*b* of the butt felt 16 having flexibility, and therefore impact noise is hardly generated.

As the key release further proceeds, the jack 13 is further moved downward. As a consequence, the hammer thrust-up part 13*b* relatively slides on the surface layer 16*b* of the butt felt 16 of the hammer assembly 4 which is performing return pivotal motion, and the base part 13*a* moves away from the regulating button 20, whereby the jack 13 finally returns to its stationary position. Thus, the hammer assembly 4 returns to the state supported by the jack 13.

As described above, according to the present embodiment, the base layer 16*a* of the butt felt 16 is formed of the high-density rayon fiber and has dimensional stability. Therefore even when key depressions cause repetitive load to act on the base layer 16*a* from the jack 13 via the surface layer 16*b*, the thickness of the base layer 16*a* hardly changes. Further, since the surface layer 16*b* formed of the fluoropolymer fiber has abrasion resistance and lubricity, abrasion of the surface layer 16*b* caused by sliding of the hammer thrust-up part 13*b* of the jack 13 can be suppressed. Furthermore, the base layer 16*a* and the surface layer 16*b* are both formed of the chemical fibers, so that even when ambient humidity changes, the thicknesses of the two layers hardly change. This causes the total thickness of the butt felt 16 to be maintained substantially constant against repetitive load from the jack 13 and changes in ambient humidity, whereby the stationary position of the jack 13 can be maintained substantially constant. As a consequence, it is possible to obtain stable key touch feeling and let-off timing.

Further, since the surface layer 16*b* is formed of the fluoropolymer fiber and hence has flexibility, it is possible to reduce a shock caused by abutment of the jack 13 during key release and prevent generation of noise.

Moreover, the regulating button 20 has basically the same construction as the butt felt 16, and hence it is possible to obtain the same advantageous effects therefrom as provided by the butt felt 16. More specifically, since the base layer 20*b* of the regulating button 20 is also formed of the high-density rayon fiber, even when key depressions cause repetitive load to act on the base layer 20*b* from the jack 13 via the surface layer 20*c*, the thickness of the base layer 20*b* hardly changes. The surface layer 20*c* is also formed of the fluoropolymer fiber, so that abrasion of the surface layer 20*c* caused by sliding of the jack 13 can be suppressed. Further, the base layer 20*b* and the surface layer 20*c* are both formed of the chemical fibers, and hence the thicknesses of the two layers hardly change against changes in humidity. From the above, it is possible to hold the total thickness of the regulating button 20 substantially constant against repetitive load from the jack 13 and changes in ambient humidity, and thereby maintain the abutment position of the jack 13 in the key-depression state substantially constant, which makes it possible to obtain stable let-off timing.

As described heretofore, the simple construction realized simply by affixing the surface layers 16*b* and 20*c* to the respective base layers 16*a* and 20*b* enables the butt 15 and the regulating button 20 to perform various functions required thereof, differently from the conventional case in which the butt felt and the regulating button are formed of the respective single materials, so that stable operations required of the jack 13 can be ensured. Further, although fluoropolymers are relatively expensive, since the fluoropolymer fiber is used only for the surface layers 16*b* and 20*c*, it is possible to suppress increase in manufacturing costs.

It should be noted that the present invention is by no means limited to the embodiment described above, but it can be practiced in various forms. For example, although in the present embodiment, the high-density rayon fiber is used for the base layer 16*a* of the butt felt 16 and the base layer 20*b* of the regulating button 20, this is not limitative, but any other suitable material which has dimensional stability against changes in humidity and repetitive load can be employed. For example, other kinds of chemical fibers, felt formed by fulling chemical fibers and wool, or artificial skins may be used for the base layer 20*b* of the regulating button 20. These materials are relatively hard, so that deformation of the base layer 20*b* caused by abutment of the jack 13 against the regulating button 20 can be suppressed, which makes it possible to further stabilize let-off timing.

Differently from deformation of the regulating button 20, instantaneous deformation of the butt felt 16 which occurs due to abutment of the jack 13 causes no problem, and hence it suffices that the thickness of the butt felt 16 remains constant in a state where the jack 13 is at rest. For this reason, the base layer 16*a* of the butt felt 16 may be formed using not the high-density rayon fiber, but a more flexible material. This makes it possible to further reduce a shock caused by abutment of the jack 13 and more effectively suppress generation of noise.

Further, although in the present embodiment, the base layer 16*a* of the butt felt 16 and the base layer 20*b* of the regulating button 20, and the surface layer 16*b* of the butt felt 16 and the surface layer 20*c* of the regulating button 20 are formed of the respective same materials, this is not limitative, but the layers 16*a* and 20*b* may be formed of different materials suited to the characteristics of the respective layers, and so may be the layers 16*b* and 20*c*.

It is further understood by those skilled in the art that the foregoing is a preferred embodiment of the invention, and that various changes and modifications may be made without departing from the spirit and scope thereof.

What is claimed is:

1. A jack motion-restricting device for an upright piano, which restricts motion of a jack operating in accordance with key depression, by having the jack abut thereagainst, comprising:

a rigid base part that is provided at a location close to the jack;

a base layer that is formed of a resilient material having dimensional stability to absorb the impact of the jack abutting the device, and is affixed to said base part; and a surface layer that is formed of a material having abrasion resistance and flexibility, and is affixed to said base layer, for having the jack abut thereagainst.

2. A jack motion-restricting device as claimed in claim 1, wherein said base part is formed of a chemical fiber.

3. A jack motion-restricting device as claimed in claim 1, wherein said surface layer is formed of a fluoropolymer fiber.

4. A jack motion-restricting device as claimed in claim 1, wherein the jack motion-restricting device is a butt against which the jack performing a return pivotal motion in accordance with key realease abuts to thereby define a stationary position of the jack in a key-released state.

5. A jack motion-restricted device as claimed in claim 1, wherein the jack motion-restricting device is a regulating button against which the jack moving upward in accordance with key depression abuts to thereby cause the jack to perform a pivotal motion to cause let-off to occur.

* * * * *